United States Patent [19]

Commanda

[11] 4,064,812

[45] Dec. 27, 1977

[54] FOLDABLE PICNIC TABLE

[76] Inventor: Ephrem Commanda, P.O. Box 1244, Espanola, Ontario, Canada

[21] Appl. No.: 696,414

[22] Filed: June 15, 1976

[51] Int. Cl.[2] ..... A47B 3/00; A47B 35/00; F24C 15/10

[52] U.S. Cl. ..... 108/36; 108/132; 108/50; 126/37 B

[58] Field of Search ..... 108/36, 35, 34, 50, 108/111, 130, 131, 132; 126/37 B, 9 R

[56] References Cited

U.S. PATENT DOCUMENTS

| | | | |
|---|---|---|---|
| 1,229,432 | 6/1917 | Ferdon | 126/9 R |
| 1,534,470 | 4/1925 | Smith | 108/130 |
| 1,964,759 | 7/1934 | Howe | 108/130 |
| 2,358,883 | 9/1944 | Rothschild | 108/35 X |
| 2,512,712 | 6/1950 | Brody | 126/37 B |
| 2,652,300 | 9/1953 | Garber et al. | 108/35 X |
| 3,208,807 | 9/1965 | Becker | 108/35 |

FOREIGN PATENT DOCUMENTS

| | | | |
|---|---|---|---|
| 508,844 | 2/1952 | Belgium | 108/34 |

*Primary Examiner*—James T. McCall
*Attorney, Agent, or Firm*—Cushman, Darby & Cushman

[57] ABSTRACT

A foldable picnic table is provided having two, similar, table top portions hinged together for folding into a position in which their undersides face each other and are parallel and spaced apart. The table has legs which fold into the space between the folded top portions. The undersides of the top portions are provided with retaining means such as clips which hold various items in place, particularly a metal grill used for cooking. Other items may be stored between the undersurfaces of the table top portions, when folded. The retaining means for the grill may be partly carried by a member foldable with the legs, so that this folds onto the grill and holds this firmly in place when the table is folded.

5 Claims, 3 Drawing Figures

FOLDABLE PICNIC TABLE

The present invention relates to picnic tables.

The invention provides a combined foldable picnic table, and metal grill useful on open picnic fires. The picnic table comprises two similar table top portions hinged together for movement from a co-planar relationship in which they provide the normal table top, to a folded relationship in which the undersides of the portions lie substantially parallel and spaced apart to provide a storage space. The portions each have two legs hingedly attached thereto so as to be foldable against the undersides of the portions and so as to fit within the space between these portions when folded. A picnic device such as a metal grill or flat board is releasably held by retaining means on the underside of the first of the table top portions and is capable of fitting within the storage space when the table is folded.

Preferably, each portion has two legs connected by a connecting member which is itself hingedly connected to the respective portion, and the retaining means include elements fixed to the connecting member and movable therewith to hold the picnic device between the elements and the underside of the table top portion when the connecting member is in its folded position.

Figure 1:
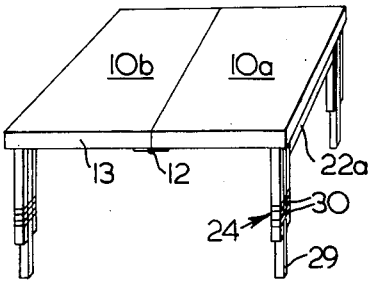
Figure 3:
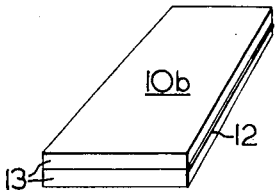
Figure 2:
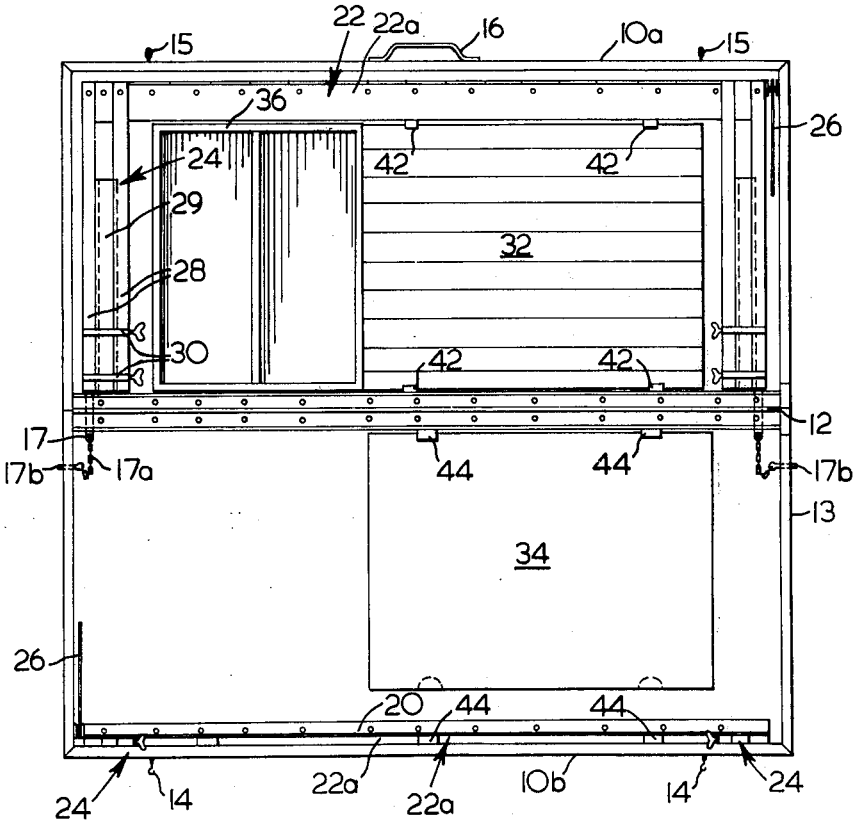

In the accompanying drawings:

FIG. 1 shows a perspective view of the picnic table in its condition for normal use, FIG. 2 shows an underside view of the picnic table with one leg portion in the folded position and the other leg portion (in the bottom part of the drawing) shown unfolded, and FIG. 3 shows a perspective view of the folded picnic table.

The picnic table comprises first and second table top portions 10*a* and 10*b*, each forming one half of the table top, and hinged together by a long piano type hinge 12. Each table top portion comprises a rectangular, flat board which is surrounded on all its four sides by a raised edging or flange 13 which extends downwardly from the underside of the board (and upwardly as seen in FIG. 2). The hinge 12 has its plates connected to the lower side of the adjacent flanges 13 of the two table top portions. With this arrangement, the two portions can be folded together with normally lower sides facing each other but separated by an amount equivalent to twice the height of the flanges 13, thus forming a space for purposes which will be described. In the folded position, hooks 14 of the portion 10*b* can be engaged with eyes 15 of the portion 10*a*, and the whole table can be carried by a handle 16. In the unfolded position, bars 17 inserted through adjoining flanges 13 hold the portions co-planar to provide a normal flat table top as indicated in FIG. 1. Bars 17 are provided with retaining chains 17*a*, and clips 17*b* to hold these bars when not in use.

Close to each outer edge of the first and second table top portions 10*a* and 10*b* is a further long hinge 20 (seen in lower part of FIG. 2), onto which is connected a leg portion indicated generally at 22. The leg portion includes a connecting member 22*a* extending along the large part of the length of each portion 10*a*, 10*b*, and having attached to each end one of the table legs 24. The legs 24, which are shown folded against the portion 10*a* and unfolded relative to portion 10*b*, are held in the unfolded position by the folding brackets 26, which retain the legs normally perpendicular to the table top portions.

Each leg 24 is telescopic, and includes two side members 28 which are attached to the member 22*a*, and a central member 29 which has a tongue and groove engagement with the side members 28 and which can be slid outwardly relative to the side members when the leg is unfolded, screw clamps 30 being provided to hold the central member 29 in its extended position.

It will be seen from FIG. 2 that with both of the leg portions 22 folded, there is provided a storage space surrounded by the legs 24 and the connecting members 22*a*, which is completely enclosed when the two table top portions are folded together as indicated in FIG. 3, The leg portions 22 are dimensioned so that when folded as shown in the upper part of FIG. 2 they do not project beyond the outer boundary of the flanges 13.

The storage space provided when the table is folded accommodates a metal grill 32, a cutting board 34, and a utensil box 36. The metal grill 32 is a foldable grill formed by parallel metal bars and connecting bars, and in the folded position as shown in FIG. 2 the dimensions of this grill are 11 inches by 15 inches. This grill unfolds to twice this size for normal use. The utility board 34 is a conventional wooden cutting board, having the same dimensions as the folded grill.

The grill and board are retained in position against the respective undersides of the two board portions by clips. Clips 42 are provided for holding the grate onto the portion 10*a*, there being two clips associated with the area of the board near to the main hinge 12, and two further clips associated with the inner edge of the member 22*a* attached to the portion 10*a*. With this arrangement, the clips attached to member 22*a* are brought to bear firmly on the grill 32 when the legs 24 are moved to the folded position, thus firmly holding the grill in place during transport. It may be noted that the firm action of the clips attached to member 22*a* does not depend merely on a spring clip action.

The utility board 34 is similarly held by two clips 44 attached to the board portion 10*b* adjacent the main hinge 12, and two further clips 44 spaced along the inner side of the connecting leg member 22*a*.

While all the clips may be made of spring metal, it will be observed that those which are attached to the leg connecting members 22*a* do not need to be spring clips since they come into action when the legs are folded.

The utensil box 36, which is used for small utensils such as knives and forks, is a rectangular box with flat bottom and open top, and with a central divider. This is dimensioned to fit snugly in the space indicated, and between the table top portions when folded, and does not require any clips. The fit is snug enough to prevent utensils falling from the box.

It is to be noted that other arrangements of foldable legs might be used in accordance with this invention. For example, a leg arrangement might be used in which the legs, when folded, extend parallel to the central hinge 12. Also, telescopic legs are not essential, since a low table may be preferred.

I claim:

1. A foldable picnic table comprising two similar table top portions hinged together along a first hinge axis for movement from a co-planar relationship providing a normal table top, to a folded relationship in which the undersides of said portions lie substantially parallel and spaced apart to provide a storage space therebetween, said portions each having two legs with a connecting member extending between and rigidly fixed to said legs, said connecting member and legs being hingedly connected to the respective table top portion by hinge means extending parallel to said first hinge axis, said legs and member being foldable against the underside of the respective table top portion and being capable of fitting between said table top portions when folded, and wherein said connecting member includes retaining means moveable therewith to hold a removable picnic device firmly against the underside of one of said table top portions when the table is folded.

2. A foldable picnic table according to claim 1, in combination with a flat picnic device such as a board or grate dimensioned to fit within the space defined by said connecting member and legs when the legs are folded against the respective table top portion, and wherein said retaining means are positioned to engage an edge of said device when the legs are folded against said table top portion.

3. A foldable picnic table according to claim 2, further comprising additional retaining means located adjacent said first hinge axis for co-operating with said first-mentioned retaining means for holding said picnic device.

4. The picnic table of claim 1, wherein said table has telescopic legs.

5. The picnic table of claim 1, in combination with a utensil box sized to fit snugly between the undersides of the table top portions when the table is folded.

* * * * *